US008995674B2

(12) United States Patent
Frye

(10) Patent No.: US 8,995,674 B2
(45) Date of Patent: Mar. 31, 2015

(54) MULTIPLE SUPERIMPOSED AUDIO FREQUENCY TEST SYSTEM AND SOUND CHAMBER WITH ATTENUATED ECHO PROPERTIES

(75) Inventor: George J. Frye, Tigard, OR (US)

(73) Assignee: Frye, Electronics, Inc., Tigard, OR (US)

( * ) Notice: Subject to any disclaimer, the term of this patent is extended or adjusted under 35 U.S.C. 154(b) by 331 days.

(21) Appl. No.: 13/484,155

(22) Filed: May 30, 2012

(65) Prior Publication Data

US 2012/0243697 A1 Sep. 27, 2012

Related U.S. Application Data

(62) Division of application No. 12/391,227, filed on Feb. 23, 2009, now Pat. No. 8,300,840.

(60) Provisional application No. 61/151,442, filed on Feb. 10, 2009.

(51) Int. Cl.
*H04R 29/00* (2006.01)
*H04R 1/20* (2006.01)
*H04R 25/00* (2006.01)

(52) U.S. Cl.
CPC ..... *H04R 29/00* (2013.01); *H04R 25/30* (2013.01)
USPC ..... 381/60; 381/345

(58) Field of Classification Search
CPC ..... G10K 11/02; G10K 11/004; H04R 25/30; H04R 25/70; H04R 25/305; H04R 25/505; H04R 1/02; H04R 1/021; H04R 1/023; H04R 1/026; H04R 1/24; H04R 1/26; H04R 1/025; H04R 1/222; H04R 1/225; H04R 1/2819; H04R 1/2826; H04R 1/2842; H04R 1/345
USPC ..... 381/60, 345, 346, 353, 354; 181/198, 181/199
See application file for complete search history.

(56) References Cited

U.S. PATENT DOCUMENTS

| | | | | |
|---|---|---|---|---|
| 3,705,957 | A | 12/1972 | Goldsmith | |
| 3,735,837 | A | 5/1973 | Duda | |
| 3,923,119 | A * | 12/1975 | Frye | 381/60 |
| 4,327,326 | A | 4/1982 | Frye | |
| 4,477,505 | A | 10/1984 | Warnaka | |
| 4,496,950 | A | 1/1985 | Hemming | |
| 5,317,113 | A | 5/1994 | Duda | |
| 5,703,797 | A | 12/1997 | Russell | |
| 6,073,722 | A | 6/2000 | Babuke | |
| 6,082,490 | A | 7/2000 | Rowland | |
| 6,371,240 | B1 * | 4/2002 | Hayes et al. | 181/30 |
| 6,373,425 | B1 | 4/2002 | Inoue | |
| 6,674,609 | B2 | 1/2004 | Boutaghou | |
| 6,793,037 | B1 | 9/2004 | Babuke | |
| 6,836,991 | B1 | 1/2005 | Saur | |

(Continued)

*Primary Examiner* — Brian Ensey
(74) *Attorney, Agent, or Firm* — Stolowitz Ford Cowger

(57) ABSTRACT

A composite sound dampening structure includes a first base layer of sound dampening material extending around and against an inside surface of a container and a second wedge layer of sound dampening material attached to an inside surface of the first base layer. The composite sound dampening structure provides improved acoustic dampening in relative small sound chambers. An audio test system generates a composite audio signal of multiple different audio signals that are combined together using linear superposition. The composite audio signal allows a device to be simultaneously tested with multiple different audio frequencies.

19 Claims, 7 Drawing Sheets

(56) References Cited

U.S. PATENT DOCUMENTS

| | | | |
|---|---|---|---|
| 6,974,421 | B1 | 12/2005 | Causevic |
| 7,062,056 | B2 | 6/2006 | Jonkman |
| 8,300,840 | B1 | 10/2012 | Frye |
| 2005/0188599 | A1 | 9/2005 | Saur |
| 2006/0185931 | A1 | 8/2006 | Kawar |
| 2009/0274307 | A1 | 11/2009 | Yoshino |

* cited by examiner

MULTIPLE SUPERIMPOSED AUDIO FREQUENCY TEST SYSTEM AND SOUND CHAMBER WITH ATTENUATED ECHO PROPERTIES

This application is a divisional application of U.S. utility patent application Ser. No. 12/391,227, filed Feb. 23, 2009, which claims priority to U.S. provisional application 61/151,442, filed Feb. 10, 2009, which are herein incorporated by reference in their entirety.

BACKGROUND

An echo, or acoustic reflection, occurs when an acoustic wave encounters an object such as an enclosure wall. When a reflection occurs, the reflected wave interacts with the wave that was originally directed towards the object causing the reflection. The waves are often labeled as the incident and reflected waves. At low amplitudes the two waves interact in simple superposition, adding to produce a sound pressure pattern in space. In a typical system, the acoustic wave/reflection result occurs in three dimensions. In an environment with walls that reflect most of the wave directed at them, points can be seen where the resultant sound pressure decreases to 10 percent or less of the amplitude of the initial incident wave.

The addition of incident and reflected waves produce a sound pressure pattern that is typically quite complicated. This pattern is also dependent on the frequencies of the waves. A complex waveform containing many frequencies will have a set of reflection patterns, each dependent on an individual frequency. The result is that it is very difficult to know the sound pressure at any point in a 3 dimensional space that contains reflective surfaces.

A device to be tested, be it a sound emission device like a speaker, a sound reception device like a microphone, or a combination device like a hearing aid, has apparent acoustic properties affected by the environment in which it is tested. If the environment contains surfaces that reflect acoustic waves, the properties of the device under test are subject to reflection artifacts. Unfortunately, surfaces and objects reflect acoustic waves. The best that can be done is to provide a surface, or combination of surfaces, that have small acoustic reflections that do not significantly affect the measurement of the device under test.

Some acoustic devices are constructed to have directional properties. For these devices it is important to measure device characteristics in an acoustic environment with few reflections. Often a chamber known as an "anechoic chamber" is used for such testing. As noted above, there is no such thing as a chamber that has no reflections. However, chambers have been constructed that have sufficient attenuation of reflections to allow reasonable testing of these directional devices. Typically, these chambers are large. Current technology uses sound absorbing wedges that are a substantial percentage of a wavelength deep. For low frequency operation, the chamber must be large in order so that the walls formed by the wedges are thick enough to absorb the sound waves.

The wedges are typically constructed using a wire form that is stuffed with fiberglass. The wire itself reflects a certain amount of acoustic energy, as does the fiberglass. If the wedges have relatively sharp edges, only very high frequencies will be reflected off of the wedge edges, and only a small percentage of the waves will be reflected back toward the generator of the incident wave.

The wedges are also constructed with relatively sharp angles. Waves that encounter a wedge side surface will reflect off the surface. The sharp angles of the wedge sides cause the wave reflection to move inward toward a surface of another adjacent wedge. The adjacent wedge then reflects the wave back toward a deeper portion of the first wedge. Thus, the acoustic wave works its way towards the wedge base and hopefully is mostly absorbed by the time the wave reaches the wedge base. Of course, the wedges hold fiberglass, which is a good absorber of sound. Therefore most of the signal that hits the side of the wedge is absorbed in the fiberglass material and only a small percentage is reflected.

The reflection behavior of a wave from a surface is dependent on the dimensions of the surface and the wavelength. If a sound chamber is small compared with the wavelength, then reflections may be ignored and the enclosure may be thought of as a pressure box. Relatively small anechoic chambers are therefore not effective for low frequencies with wavelengths that exceed the dimensions of the chamber. The damping action of the wedges in a sound chamber is also reduced when the dimensions of the wedges are an appreciable percentage of a wavelength.

In recent years, certain types of open cell foams have been available for acoustic damping of surfaces in chambers and rooms. Some of these foams have desirable properties that reduce sound transmission through the foam and also attenuate reflections of waves directed at the surface of the foam. The foams come in a variety of densities and construction.

As with fiberglass, sound incident on a foam surface is partially reflected as well as attenuated upon entering the material. A portion of a sound wave hitting a simple surface covered with a thickness of foam will be reflected from the surface of the foam and a portion will travel into the foam. If the thickness of the foam is increased, sound will be attenuated as it proceeds through the foam. When the sound travels completely through the foam thickness, it will eventually encounter the underlying surface. For example, a concrete or wood wall surface that supports the foam. Most of the sound encountering this surface will be reflected back into the foam material and undergo further attenuation before emerging from its outer surface.

Thus an incident sound wave encountering a simple plane damping surface will split. Some will be reflected and the rest will travel into the damping material and eventually emerge attenuated in amplitude. This returning attenuated sound will add to the initially reflected sound from the front surface of the damping material. The portion of the incident sound that is initially reflected from the front surface appears to be unaffected by an increase in the thickness of the damping material.

Acoustic devices of all types, including receivers (microphones) and generators (speakers), have a pattern to the way they operate. The sound that they receive or generate typically has a 3 dimensional directional component. For speakers, the sound emanating from the device is typically directed in one particular direction more than other directions. The same is sometimes true for microphones. Sometimes microphones or devices that employ microphones are constructed in a way that enhances the directional capability of the device. The directional characteristic of the acoustic device is also typically dependent on the acoustic frequency. Because of the wavelength nature of a sound wave, devices handle different frequencies in different ways.

From an engineering and manufacturing perspective, it is desirable to know the pattern that the acoustic device exhibits at each frequency. Tests are typically run on the device in areas that are as free of reflected sound as possible, such as in an anechoic chamber or in a chamber free of echo. Sounds from speakers can then be tested for their directional pattern.

Microphones can be located at different points in the sound generation path of the speaker to collect this information. Or the microphone can be kept in one spot and the speaker moved to different orientations for the test.

Directional microphones can be tested in similar ways. The microphone can be held in a constant position and the sound source moved to make a test, or the microphone orientation can be changed, holding a fixed sound source location.

The typical system will test the speaker or microphone directional pattern characteristic one frequency at a time. The data is often displayed in a graphical format called a polar plot. The plot exhibits the directional performance of the device for that frequency in a particular plane of operation and is labeled as amplitude vs. angular position within that plane.

Another possible display of the information is in the form of a series of overlaid frequency response curves. Each curve has a different positional angle from a reference angle. Sometimes this information will be confined to the angle at which the greatest sensitivity or efficiency is demonstrated and the angle at which the sound is at the lowest amplitude. There are a number of ways in which the information may be displayed.

DETAILED DESCRIPTION

Sound Chamber with Attenuated Echo Properties

It is desirable in the testing of small acoustic devices like microphones and hearing aids to build small chambers with desirable nearly anechoic properties. It is also known that traditional anechoic techniques require large chambers or rooms to achieve a desired reduction in reflection from chamber surfaces. Therefore a different technique is needed when constructing a small chamber with desired anechoic properties. Because of the surface reflection problems noted above, there is a limit to the amount of reflection reduction that can be achieved with the use of simple plane foam damping materials placed on the surfaces of a sound chamber.

Figure 1:
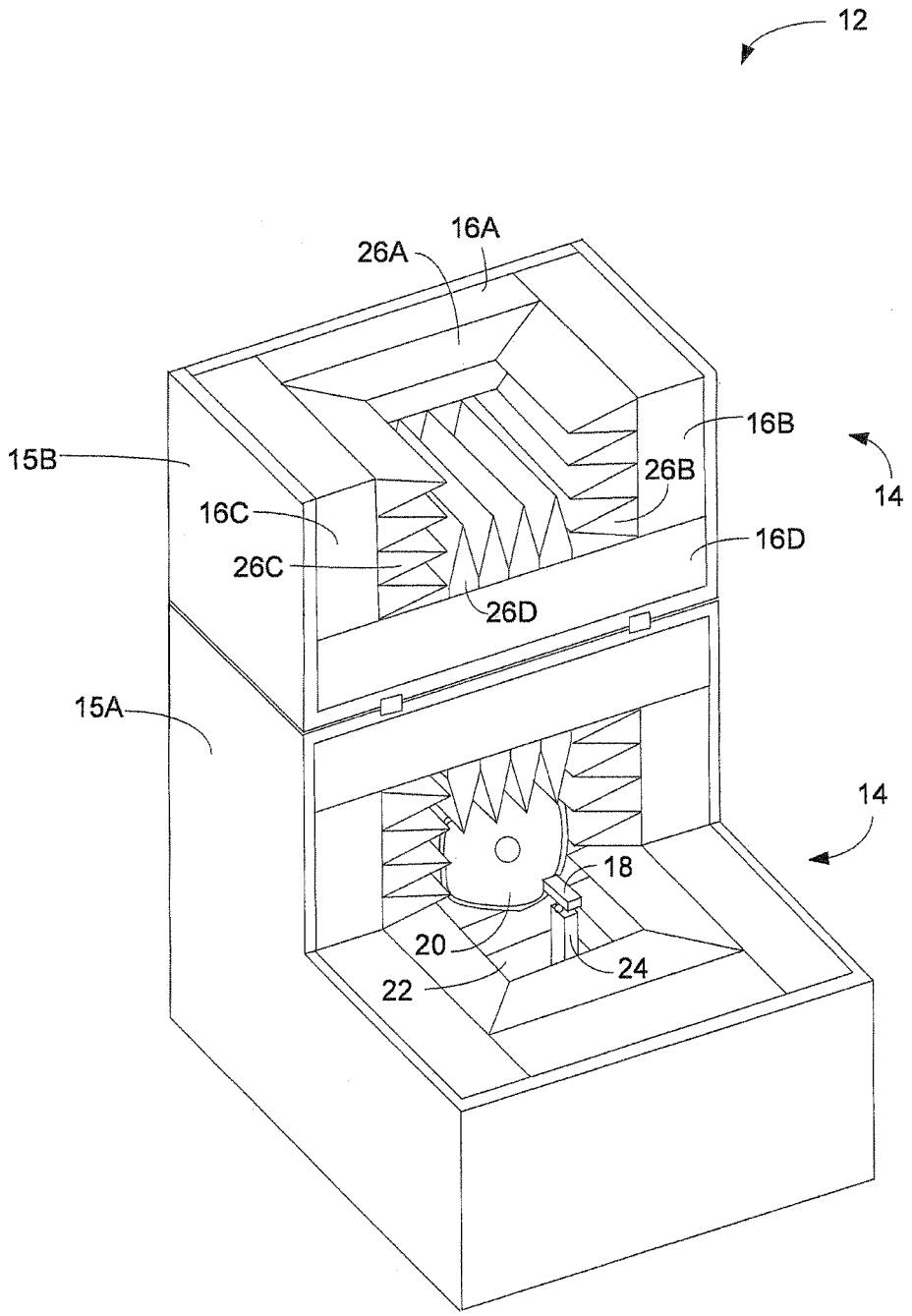
FIG. 1 is a diagram of a sound chamber with improved sound dampening.

FIG. 1 shows a new composite dampening structure 14 that reduces reflections of acoustic energy in a relatively small sound chamber 12. The sound chamber 12 includes an exterior wooden box 15 having a bottom portion 15A that contains a speaker 20 and a device under test (DUT) 18. An upper portion 15B of the box 15 rotates downward and covers a lower open section of bottom portion 15A. The DUT 18 can be any type of audio device that requires acoustic testing. For example, the DUT 18 may be a directional microphone, hearing aid, transducer, speaker, or any other type of audio transmitter or receiver.

The relatively small sound chamber 12 uses the composite damping structure 14 to substantially reduce the reflection of audio signals. The composite damping structure 14 includes a layer of wedges 26 made of a first damping material and a second base layer 16 made of another damping material. In one embodiment, the wedges 26 and base layer 16 are both constructed of a foam material. However, in some embodiments the wedges 26 and base layer 16 are made of different types of foam materials.

The composite dampening structure 14 forms an inner cavity 22 where the speaker 20 and DUT 18 are located. A support column 24 suspends the DUT 18 in the middle of the cavity 22 and the speaker 20 is located on the back end of the lower box portion 15A. The composite damping structure 14 surrounds the periphery of the speaker 20 and extends around the sides, top, and bottom of the entire cavity 22.

Figure 2:
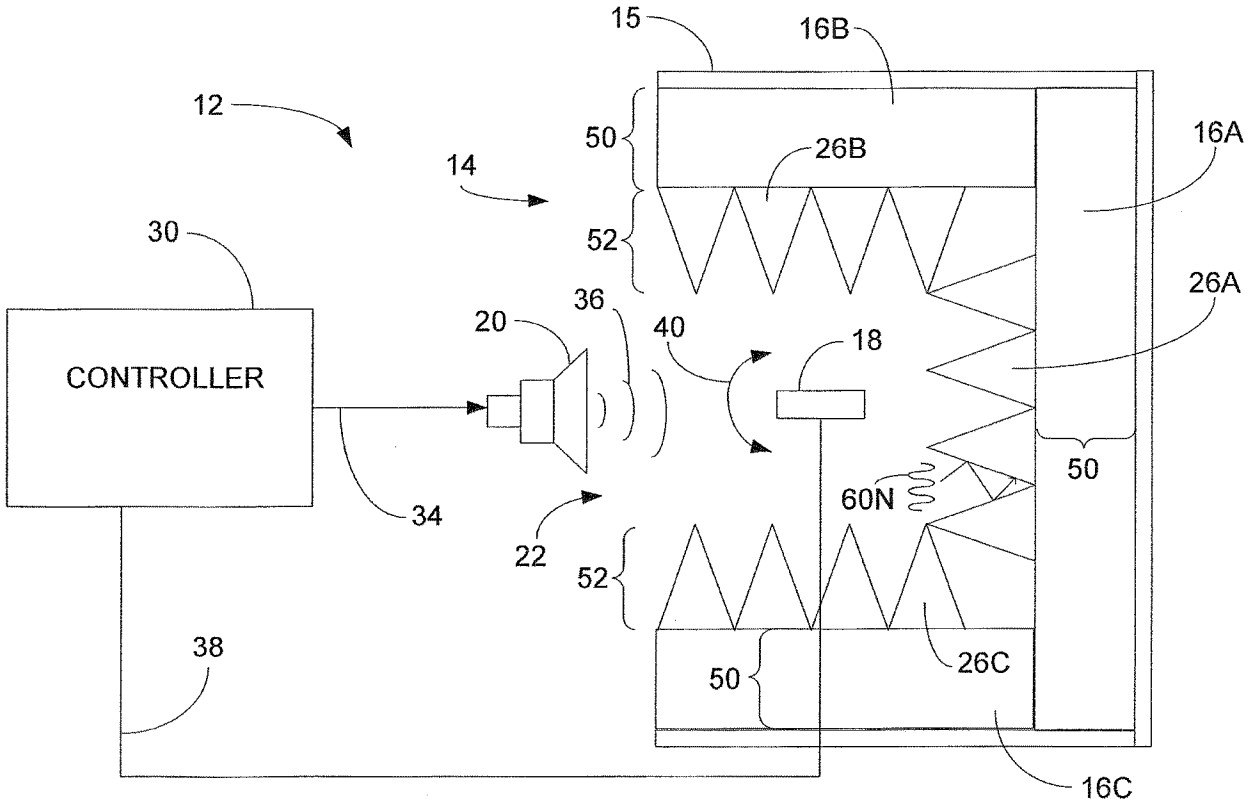
FIG. 2 is a partial top sectional view of the sound chamber shown in FIG. 1.
Figure 3:
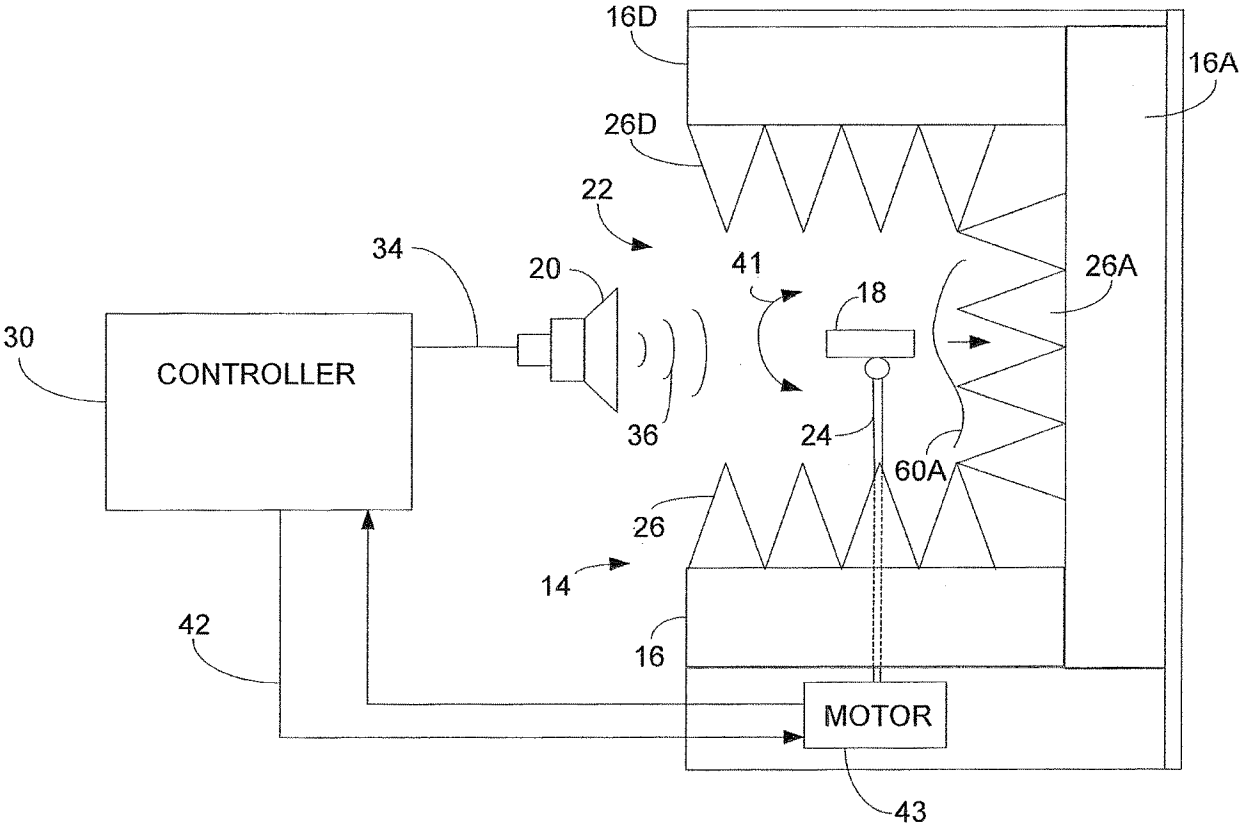
FIG. 3 is a partial side sectional view of the sound chamber shown in FIG. 1.

FIG. 2 is an isolated top sectional plan view of the sound chamber 12 and FIG. 3 is an isolated side sectional view of the sound chamber 12. The wedges 26A are shown in a vertically aligned orientation in FIG. 2 for illustrative purposes but could alternatively be aligned horizontally as shown in FIGS. 1 and 3. Similarly, the side wedges 26B and 26C could be aligned in horizontal orientations as shown in FIG. 1 or in vertical orientations as shown in FIG. 2.

A controller 30 generates electronic signals 34 that are output as audio waves 36 by speaker 20. The receiver 18 detects the audio waves 36 and generates an electronic test signal 38. The controller 30 controls what acoustic frequencies are output from speaker 20. The controller 30 can also change the orientation 40 of the DUT 18 either horizontally or vertically with respect to the speaker 20 according to control signals 42. In one embodiment, a slight rotation of the DUT 18 is allowed for improving response, but there is no vertical orientation adjustment, and only rotation of the DUT in the horizontal plane is provided. Of course other rotation and orientation configurations are also possible.

In one embodiment, the wedges 26 have a height 52 of about 2.5 inches and a base width of around 1.0 inches. The base layer 16 has a thickness 50 of around 1.5 inches and extends around the entire inside surface of wooden box 15. The cavity 22 is around 4 inches in width, length, and 8 inches in height. The box 15 is around 12 inches in height and width, and around 16 inches in depth.

In one embodiment, the wedges 26 are made from a felt open cell foam, such as a permanently compressed reticulated foam (SIF) with a grade of 900 with 90 pores per lineal inch. The foam used for wedges 26 is made by Scotfoam Corporation of Eddystone, Pa. In one embodiment, the form used in the base layer 16 is reconstituted carpet foam with a 5 pound (lb) rebond.

In one embodiment, the wedges 26 have a stiffer structure than the base layer 16. The shape of the wedges 26 allows a stiffer material to be used without significant acoustic reflections. The base layer 16 has a relatively flat shape that is substantially perpendicular to the direction of wave travel. Therefore, the base layer 16 is made of a softer material to improve sound absorbsion and further reduce sound reflections. These are just examples of the possible combination of dimensions and stiffness for the composite damping structure 14 used in sound chamber 12. Other material shapes, sizes, and stiffness could also be used.

The wedges 26 provide two functions. At high frequencies, the wedges 26 act like the wedges in traditional anechoic sound chambers. The wedges 26 have sharp sides that reflect smaller acoustic waves 60*n* (FIG. 2) inward toward the base of the wedges 26. At lower audio frequencies 60A (FIG. 3), the wedges 26 act as transition elements, providing a progressively greater and greater density of damping foam material as relatively large acoustic waves 60A propagate inward toward the base layer 16. Thus the initial energy that would have normally been reflected because of the abrupt transition from air to foam is reduced significantly by wedges 26.

Thus, the composite damping structure 14 comprising the foam wedges 26 with relatively sharp edges in combination with the relatively thick base foam layer 16 provides improved sound dampening. As a result, the wedges 26 do not have to be as tall or large to dampen a larger range of audio frequencies. This allows the sound chamber 12 to have a relatively smaller size than conventional anechoic chambers. The overall reduction of acoustic reflections provided by the composite damping structure 14 allows devices like directional microphones and hearing aids to be tested in a relatively small space.

Simultaneous Testing of Multiple Audio Frequencies

While it is possible to make directional tests one frequency at a time for each rotation of a device under test, it is desirable to collect and measure directional pattern information by collecting the patterns of several frequencies with only one rotation of the device under test. It is possible to present several pure tone test signals sequentially, one after another, at each rotational position. However, it is faster for all of the test frequencies to be presented, and results measured, simultaneously.

A multi-frequency acoustic test system uses linear superposition to combine multiple different pure tone components together into a single composite test signal. The composite test signal is then applied to a device under test so the device can be tested with multiple different frequencies at the same time. This allows complete multi-frequency testing of the device in one rotation.

Composite Signal Generation

Figure 4:
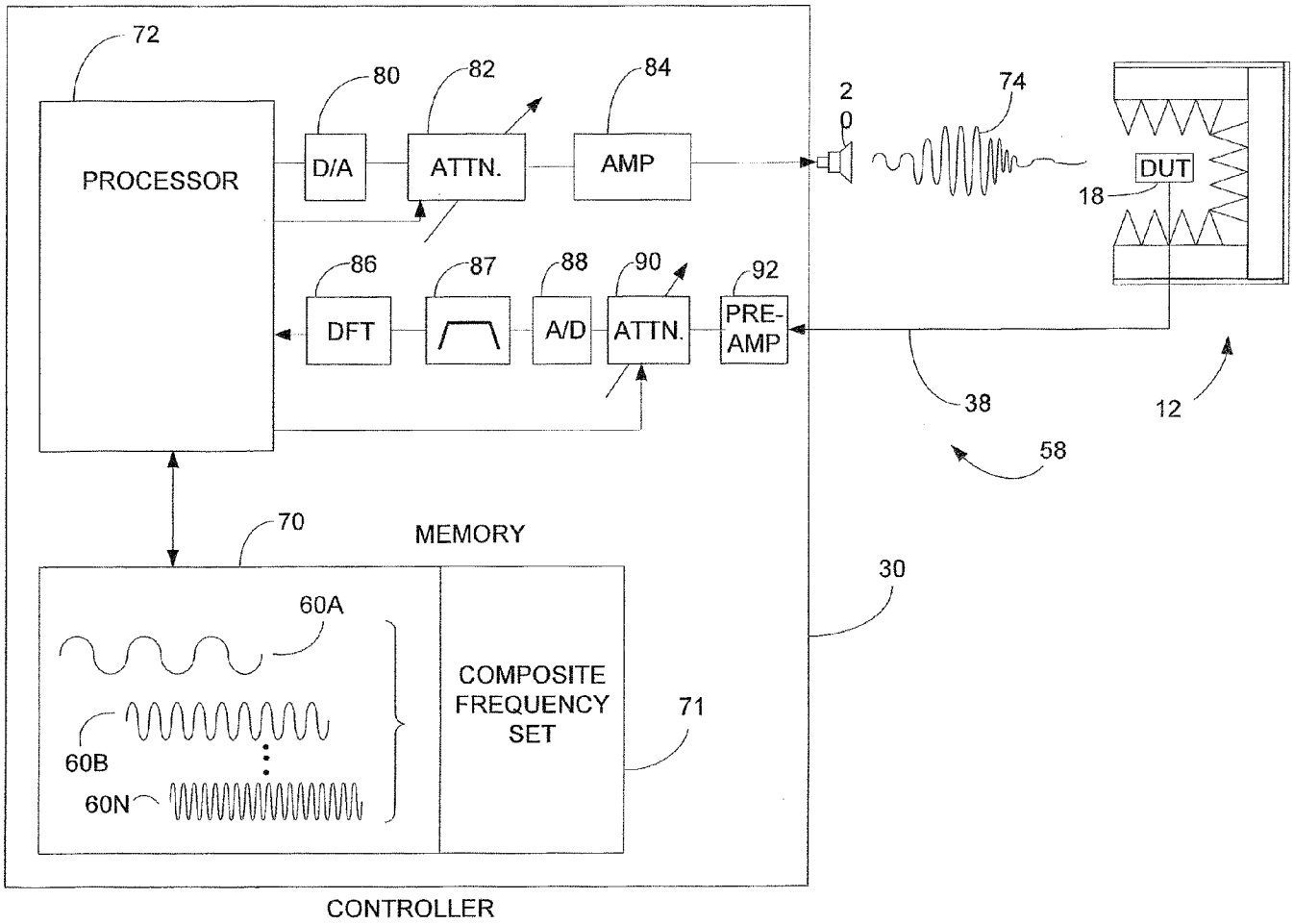
FIG. 4 is a block diagram of a multi-frequency testing system.
Figure 5:
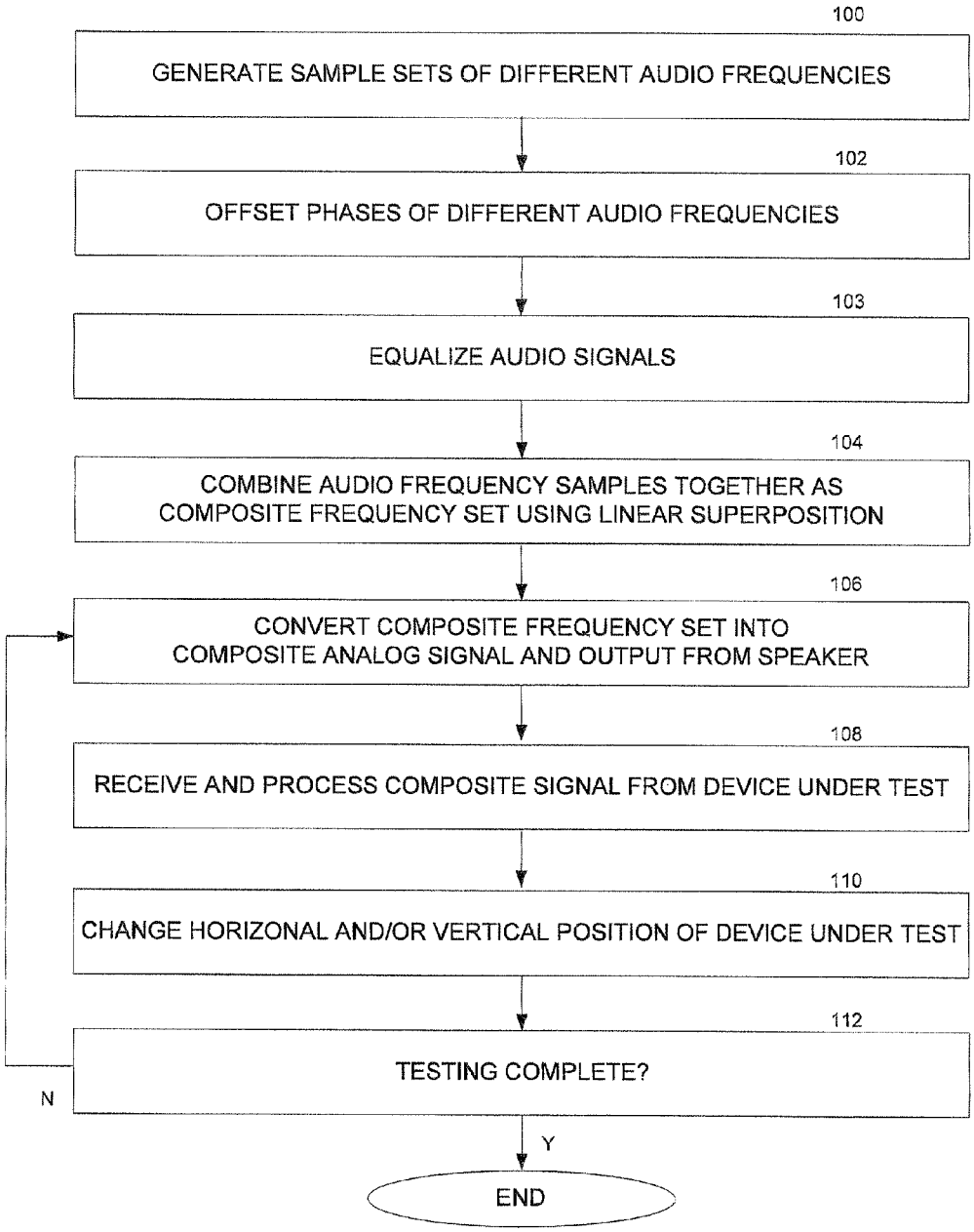
FIG. 5 is a flow diagram showing in more detail how the testing system in FIG. 4 generates a composite acoustic signal.

FIG. 4 shows an audio testing system 58 that includes controller 30, speaker 20, and sound chamber 12. FIG. 5 is a flow diagram further explaining how a composite audio signal 74 is generated. The controller 30 in FIG. 4 includes a processor 72 and a memory 70. It should be understood that some of the individual functions shown in FIG. 4 may be performed by the processor 72. For example, a Discrete Fourier Transform (DFT) 86 and window function 87 may be performed by the processor 72 in response to software instructions. However these functions are shown as separate boxes in FIG. 4 for explanation purposes.

The memory 70 stores a composite frequency set 71 that contains samples from multiple different audio signals 60 with different frequencies. The different audio signals 60 are shown in separate analog form in FIG. 4 for illustration purposes. However, the memory 70 actually contains digital values in composite frequency set 71 that represent different samples for each of the different audio signals 60. In one embodiment, the memory 70 contains one set of digital samples 71 for all of the different audio frequency signals 60A-60N.

Any number of different audio signals 60A-60N can be used to create the composite frequency set 71. However, in one embodiment, the composite frequency set 71 contains samples for around 80 different audio frequencies. The period of a base frequency 60A is set by the width of a time window and generates the lowest frequency in the composite set 71. Each additional frequency 60B-60N in the composite set 71 is an integer multiple of the base frequency 60A. In operation 100 of FIG. 5 sample sets are generated for different audio frequencies.

The width of the time window used for obtaining samples of signals 60A-60N is adjusted to be exactly the same as a rectangular window 87 used for filtering test data received back from the DUT 18 prior to performing Discrete Fourier Transform (DFT) frequency analysis. For a base frequency 60A of 100 Hz, a time window 10 milliseconds (mSec) wide is used for collecting the needed samples. If 256 samples are collected in this 10 mSec time period, audio frequencies up to a maximum of 12.8 kHz (the Nyquist frequency) can be analyzed. Of course, different numbers of samples and different widow sizes could also be used.

Time delays related to the generation of the composite signal, the transmission of the resulting composite analog signal 74 from the speaker 20 to the DUT 18, and the device under test are also taken into account. It is typically necessary to generate and hold the composite signal 74 constant for a period of time longer than the width of a single time window. This gives the system enough time to receive and test a full 10 mSec period of the composite analog signal 74.

The phases of the individual frequencies 60A-60N are typically skewed or offset in operation 102 to arrive at a desirable signal crest factor. Crest factor is equal to the peak amplitude divided by the RMS amplitude of the signal. When a series of sinusoidal signals that are integer multiples of each other are all added together with no difference in their individual phases, the result is a composite signal with a very high crest factor. Therefore, in constructing a composite signal the phases of the individual frequencies 60A-60N are typically skewed or offset in operation 102 to arrive at a desirable signal crest factor. The phase shift added to each frequency may be changed from one system to another to arrive at different desired properties.

If the DUT 18 is a directional microphone, it may be desirable to first individually equalize the amplitudes for each of the different audio frequencies 60A-60N in operation 103 so that the amplitude of each frequency component is of a desired value. This can be done by using a reference microphone instead of DUT 18 for first recording the frequency response of the transducer in speaker 20. The amplitude of each frequency component of the composite signal can then be adjusted to arrive at a desired measured amplitude. The actual DUT 18 is then placed in the same position previously occupied by the reference microphone.

The samples of the different audio frequencies 60A-60N are combined together into a single composite frequency set 71 in operation 104 using linear superposition. The digital composite frequency set 71 is converted into an analog signal by a digital to analog (D/A) converter 80 in FIG. 4. The output of D/A 80 is selectively attenuated by attenuator 82. An amplifier 84 amplifies the composite signal prior to being output from speaker 20 as composite analog signal 74 in operation 106.

The DUT 18 receives the composite analog signal 74 and generates a test signal 38. The test signal 38 is then processed by the controller 30 in operation 108. The controller 30 in operation 110 may then send control signals 42 to the motor 43 (FIG. 3) that rotates the DUT 18 into a different horizontal and/or vertical position. The controller 30 then outputs another composite analog signal 74 in operation 106 for testing the DUT 18 again in the new position. This process repeats until the DUT 18 is tested with the composite analog signal 74 at each desired position in operation 112. In one example, the DUT 18 is rotated and tested in different positions around a 360 degree circle.

Data Collection

Figure 6:
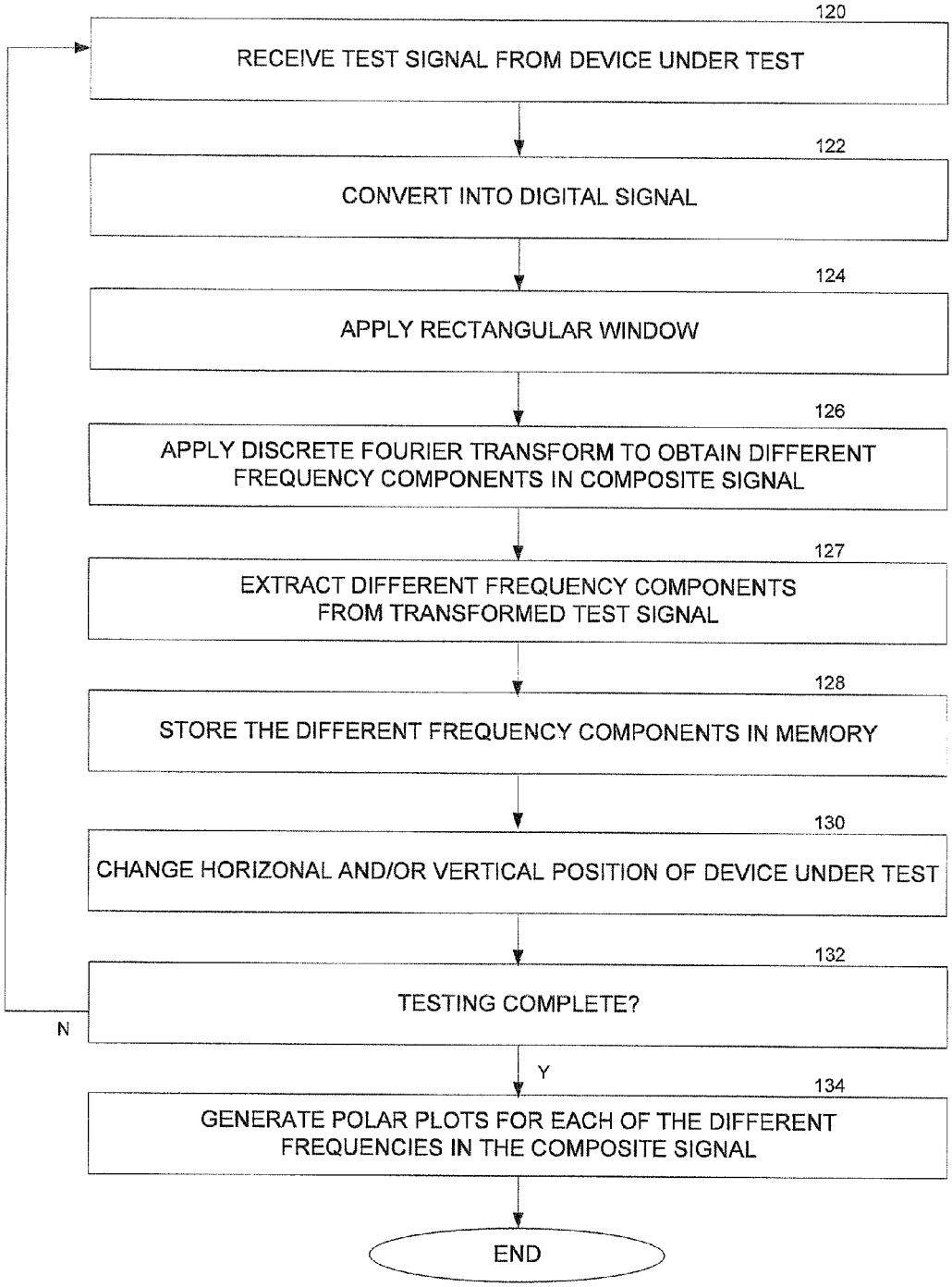
FIG. 6 is a flow diagram showing in more detail how the testing system in FIG. 4 identifies frequency characteristics for a device tested using the composite acoustic signal.

Referring now to FIGS. 4 and 6, with the source and collection systems synchronized, a complete determination of the amplitudes of multiple different frequency components can be determined with the collection of only one composite set of samples 71. The DUT 18 generates a test signal 38 in response to the composite analog signal 74 in operation 120. A pre-amplifier 92 amplifies the test signal 38 and an attenuator 90 attenuates the amplitude of the analog test signal according to a signal generated by the controller 30.

The different responses of the DUT 18 to the multiple different audio frequencies 60 superimposed into the composite signal 74 are all contained in the test signal 38. It is therefore necessary to unravel and extract these different frequency responses from test signal 38. It is possible to extract the individual frequency responses one at a time using analog filters, with the filter outputs measured by conventional means.

However, in the embodiment shown in FIG. 4, the different frequency responses are obtained by first digitally sampling the composite test signal 38 with A/D 88 in operation 122. A rectangular window 87 is then applied in the digital samples in operation 124 that coincides with the 10 mSec window of 256 samples used for generating the composite frequency set 71.

A mathematical filter 86 is applied in operation 126 to generate the different frequency components contained in the test signal 38. In one embodiment, the filter 86 is a Discrete Fourier Transform (DFT) or a Fast Fourier Transform (FFT). The amplitudes of the different frequency components are extracted from the transformed test signal in operation 127 and stored in a table located in memory 70 in operation 128. The controller 30 then may change the position of the DUT 18 in operation 130 as explained above in FIGS. 2 and 3. The controller 30 then outputs the same composite analog signal 74 as explained above in FIG. 5. The controller 30 goes back to operation 120 and again generates another test signal 38 associated with the new position of the DUT 18. The controller 30 repeats operations 122-130 until all of the different DUT positions have been tested with the composite signal 74 in operation 132.

The controller 30 may then further process and display the test results. The controller 30 may display different frequency responses for the DUT 18 on a graphical user interface (GUI). For example, a user may select a particular frequency for displaying or printing out by the controller 30. The controller 30 may then display the response of the DUT 18 for the selected frequency at each of the different DUI positions. Alternatively, a user may direct the controller 30 to display multiple frequency responses for one particular DUT position. The controller 30 accordingly, obtains the amplitude data from memory 70 for all of the multiple frequencies at that particular DUT position and displays or prints out the identified data on a GUI (not shown). It is also possible to display the results of the measuring function before the complete 360 degree rotation of the DUT and before the complete polar plot is derived.

Figure 7:
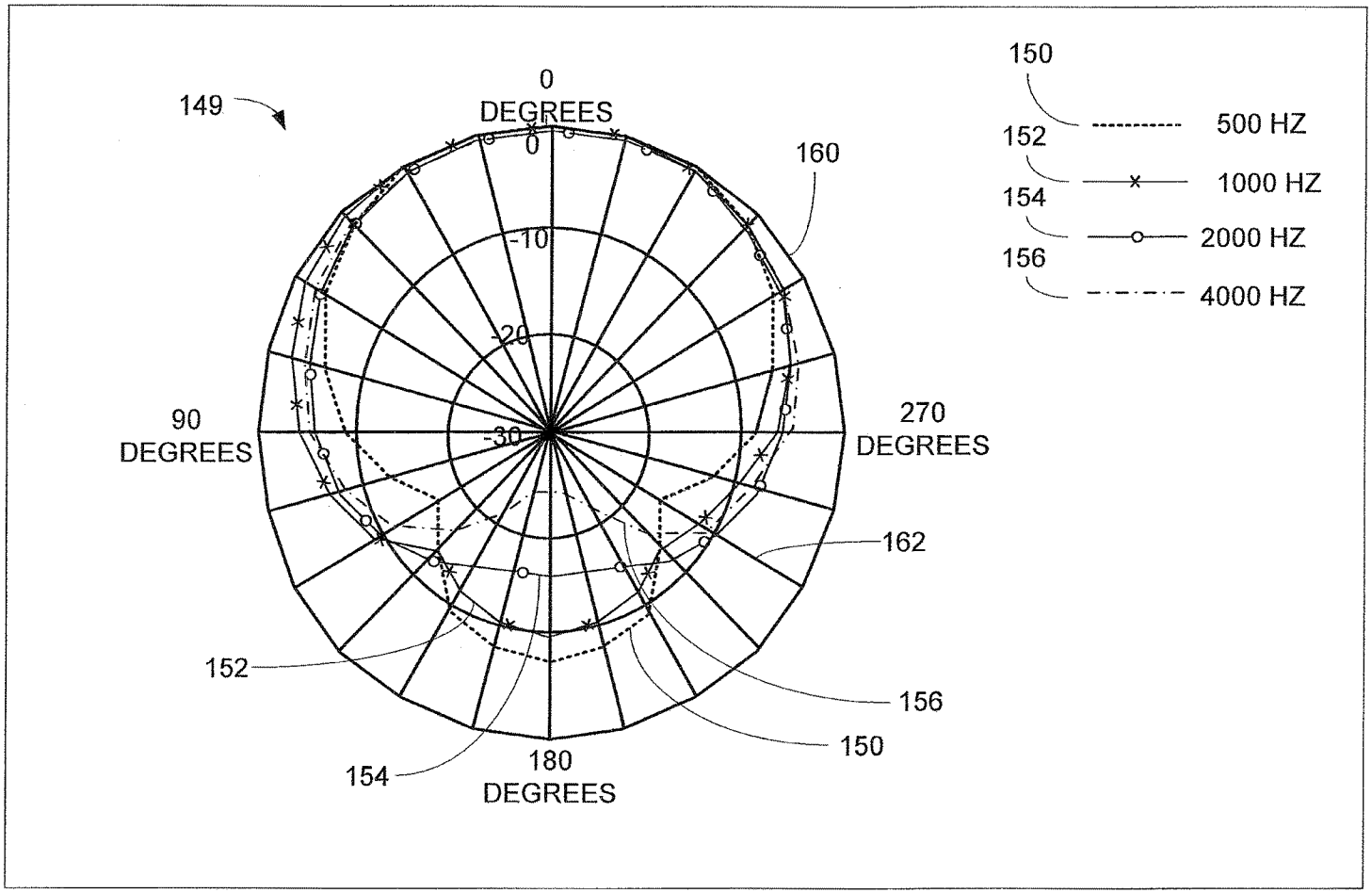
FIG. 7 is a polar plot generated from frequency characteristics identified in FIG. 6

FIG. 7 shows a polar plot 149 that can be generated by the controller 30 from the test signal 38 described above. Each smaller circle 160 in polar plot 149 represents a drop of ten decibels (dbs). Each line 162 extending radially outward from the center of polar plot 149 represents a different orientation of the DUT 18 with respect to the speaker 20. For example, at zero degrees, the front of the DUT 18 may be pointed directly at the speaker 20.

As explained above the DUT 18 can be rotated to different positions in a 360 degree horizontal plane as well as being rotated into different positions in a vertical plane. For each of the different rotational positions of the DUT 18, the controller 30 determines the gain values for the amplitude components for each of the different frequencies contained in the test signal 38 (FIG. 4). The controller 30 then builds a table in memory 70 that contains each of the different gain values for each of the different frequencies and associated DUT positions. The data in the table is then used to generate polar plot 149.

The polar plot 149 includes a plot 150 showing the signal gain for a frequency of 500 Hz, a plot 152 showing the gain for a frequency of 1000 Hz, a plot 154 showing the signal gain for a frequency of 2000 Hz, and a plot 156 showing the signal gain for a frequency of 4000 Hz. Of course the gain for other frequencies can also be plotted by the controller 30.

Because all of the multiple different frequency components are contained within the same test signal 38, the DUT 18 only has to be rotated once 360 degrees inside of the sound chamber 12 in order to generate all of the plots 150-156. Thus, the audio test system 58 requires less time to test audio devices and allows polar plots to be generated with a single 360 rotation of the DUT 18.

The system described above can use dedicated processor systems, micro controllers, programmable logic devices, or microprocessors that perform some or all of the operations. Some of the operations described above may be implemented in software and other operations may be implemented in hardware.

For the sake of convenience, the operations are described as various interconnected functional blocks or distinct software modules. This is not necessary, however, and there may be cases where these functional blocks or modules are equivalently aggregated into a single logic device, program or operation with unclear boundaries. In any event, the functional blocks and software modules or features of the flexible interface can be implemented by themselves, or in combination with other operations in either hardware or software.

Having described and illustrated the principles of the invention in a preferred embodiment thereof, it should be apparent that the invention may be modified in arrangement and detail without departing from such principles. I/we claim all modifications and variation coming within the spirit and scope of the following claims.

The invention claimed is:

1. A sound dampening device, comprising:

a portable container; and a composite sound dampening structure comprising a first base layer of sound dampening material extending around and against an inside surface of the container and a second wedge layer of sound dampening material attached to an inside surface of the first base layer, the composite sound dampening structure forming an internal cavity inside of the container configured to retain a speaker and audio receiving device, wherein the first base layer is softer than the second wedge layer.

2. The device according to claim 1 wherein a height of the second wedge layer is over 1.5 times a thickness of the first base layer.

3. The device according to claim 1 wherein the first and second layers of the composite sound dampening structure each comprise a foam or fiberglass material.

4. The device according to claim 1 wherein the second wedge layer comprises a felted open cell foam and the first base layer comprising a 5 pound carpet foam.

5. The device according to claim 1 wherein the first layer is around 1.5 inches thick and the wedges are around 2.5 inches in height.

6. The device according to claim 5 wherein the container is around 12-15 inches in height and width, and around 16 to 19 inches in depth and the cavity formed in the center of the container by the composite sound dampening structure is around 4 inches in height and width and around 8 inches in depth.

7. A sound dampening device, comprising:

a portable container;

a composite sound dampening structure comprising a first base layer of sound dampening material extending around and against an inside surface of the container and a second wedge layer of sound dampening material attached to an inside surface of the first base layer, the composite sound dampening structure forming an internal cavity inside of the container configured to retain a speaker and audio receiving device; and a test system configured to superimpose multiple different acoustic signals having different frequencies together into a single composite signal that is output from the speaker and used for testing directional and frequency characteristics of the audio receiving device contained within the cavity of the container.

8. The device according to claim 7 wherein the test system is further configured to convert a test signal received from the audio receiving device in response to the composite signal into separate frequency and amplitude components corresponding with the different acoustic signals and convert the frequency and amplitude components into polar plots corresponding to the different acoustic signal frequencies.

9. The device according to claim 7 further comprising a support structure including a column that extends up from a bottom floor of the chamber through both the first base layer and second wedge layer and suspends the audio receiving device within the cavity formed in the container, the support structure rotating the device under test into different horizontal and/or a vertical orientations with respect to the speaker.

10. A system for attenuating echo in acoustic waves, comprising:

a first base layer of sound dampening material having a first side for placing against an inside surface of a wall, the first base layer configured to attenuate the acoustic waves; and a separate second sound dampening layer having a first side for attaching to a second side of the first base layer and a second side for initially receiving the acoustic waves, wherein the second sound damping layer is stiffer than the first base layer, the second layer is configured to attenuate smaller acoustic waves while also reflecting the smaller acoustic waves toward the first base layer for further attenuation, and the second layer is further configured to provide reduced reflections and attenuation of larger acoustic waves while the larger acoustic waves move toward the first layer for additional attenuation.

11. The system according to claim 10 further comprising a relatively small portable acoustic test chamber having an inside surface that is substantially covered by the first and second layer.

12. The system according to claim 11 wherein the first and second layer form an inside cavity within the test chamber configured to retain and test directional acoustic characteristics of a microphone or speaker.

13. The system according to claim 11 wherein the first and second layer form an inside cavity within the test chamber configured to retain and test directional acoustic characteristics of hearing aids.

14. The system according to claim 11, further comprising a support structure suspending an audio receiving device within the test chamber, wherein the support structure is configured to rotate the audio receiving device into different horizontal and/or a vertical orientations with respect to a speaker.

15. The system according to claim 14 wherein:

the first layer comprises substantially rectangular or square pieces of foam and the second layer comprising wedges with a triangular cross-sectional shape; and a height of the second sound damping layer is over 1.5 times a thickness of the first base layer.

16. A sound dampening device, comprising:

a portable container;

a sound dampening structure extending around and against an inside surface of the container, the sound dampening structure forming a cavity inside of the container configured to retain a speaker and audio receiving device; and a support structure including a column that extends up from a bottom floor of the portable container and suspends the audio receiving device within the cavity, the support structure configured to rotate the audio receiving device into different horizontal and/or a vertical orientations with respect to the speaker.

17. The sound dampening device of claim 16, further comprising a test system configured to superimpose multiple different acoustic signals having different frequencies together into a single composite signal that is output from the speaker for testing directional and frequency characteristics of the audio receiving device.

18. The sound dampening device of claim 17, wherein the test system is further configured to convert a test signal received from the audio receiving device in response to the composite signal into separate frequency and amplitude components corresponding with the different acoustic signals and convert the frequency and amplitude components into polar plots corresponding to the different acoustic signal frequencies.

19. The sound dampening device of claim 16, wherein the sound damping structure comprises a first base layer of sound dampening material extending around and against the inside surface of the container and a second wedge layer of sound dampening material attached to an inside surface of the first base layer, wherein the first base layer is softer than the second wedge layer.

* * * * *